US005376054A

United States Patent [19]

Kwasny et al.

[11] Patent Number: 5,376,054

[45] Date of Patent: Dec. 27, 1994

[54] MULTIPLE USE BILLIARD BALL RACK

[76] Inventors: Charles D. Kwasny, 55 Cresent Rd., Pawtucket, R.I. 02861; Francis E. McDonald, 191 Beech St., Wrentham, Mass. 02093

[21] Appl. No.: 76,003

[22] Filed: Jun. 14, 1993

[51] Int. Cl.[5] ..... A63D 7/00

[52] U.S. Cl. ..... 473/40

[58] Field of Search ..... 473/40, 41

[56] References Cited

U.S. PATENT DOCUMENTS

| | | | |
|---|---|---|---|
| 1,086,254 | 2/1914 | West | 473/40 |
| 1,089,140 | 3/1914 | Madigan | 473/40 |
| 1,115,911 | 11/1914 | Dickinson | 473/40 |
| 1,725,494 | 8/1929 | Varnum | 473/40 |
| 4,452,450 | 6/1984 | Cayton | 473/40 |
| 4,469,328 | 9/1984 | Pacitte | 473/40 |
| 4,984,788 | 1/1991 | Harriman | 473/41 |

*Primary Examiner*—Theatrice Brown

*Attorney, Agent, or Firm*—Robert J. Doherty

[57] ABSTRACT

A billiard ball rack for shaping a group of billiard balls on a pool table having leg members which when in a storage position enables the rack to be used as a standard triangular fifteen ball rack yet when moved to an alternate position such leg members in combination with other rack portions enables the rack to be alternately used as a diamond shape nine ball rack.

20 Claims, 3 Drawing Sheets

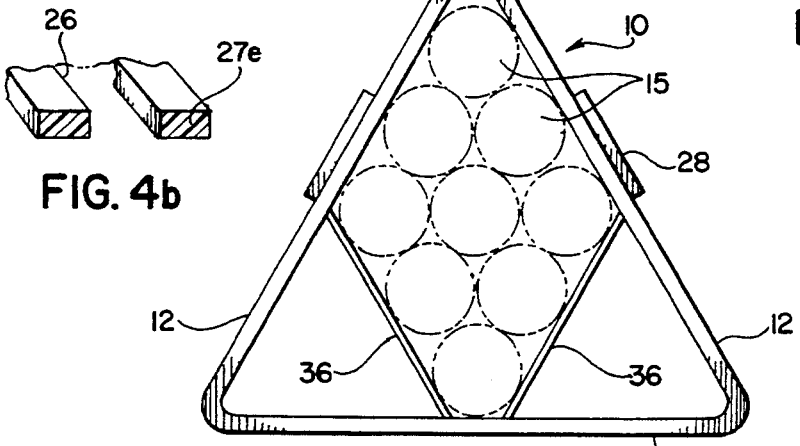
FIG. 3
FIG. 4b
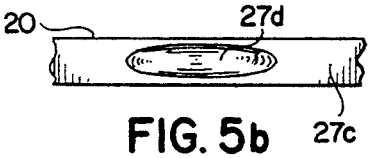
FIG. 5b
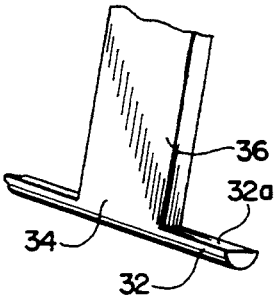
FIG. 5c
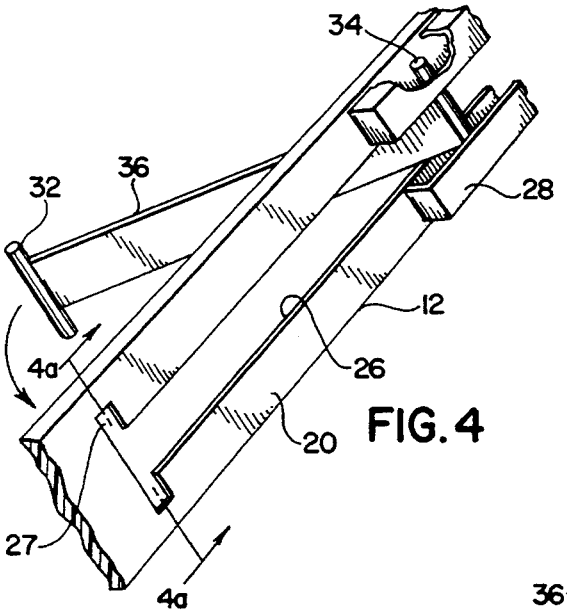
FIG. 4
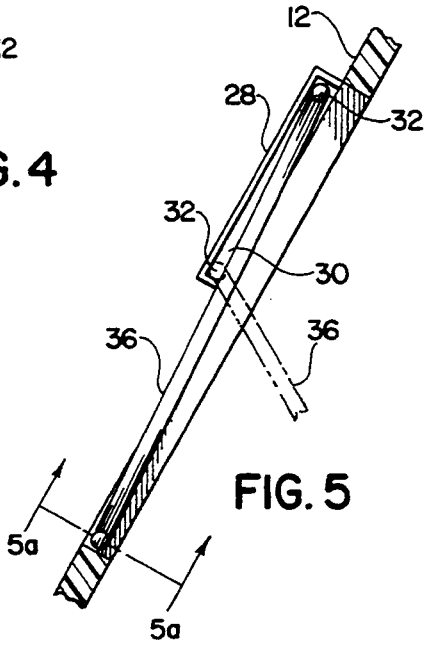
FIG. 5
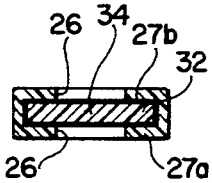
FIG. 5a
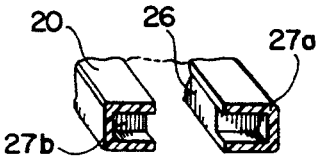
FIG. 4a

MULTIPLE USE BILLIARD BALL RACK

BACKGROUND AND OBJECTIVES OF THE INVENTION

This invention relates to an improved billiard ball rack and particularly to a rack which will easily convert from a standard triangularly-shaped rack to a diamond shaped rack.

In the various games falling under the general category of pocket billiards or pool, the balls are arranged during certain points of these games in a pattern on a designated location on the pool table. The usual pattern is triangular shape using fifteen numbered balls. Other games use different patterns, for example, a diamond shape using nine balls. In both of these instances, a rack shaped in the pattern and sized to receive the group of balls is used. It is, accordingly, necessary to utilize a separate rack to arrange the billiard balls in the above-indicated patterns. This necessitates both the purchase and storage of separate racks. This not only creates an inconvenience to the owner of a single billiard table but can create significant expense and concern to owners and managers of multiple table facilities especially in light of the increasing popularity of various billiard games.

It would, accordingly, be desirable to provide a billiard rack which has alternate use positions thus enabling various games to be played with only one rack thus reducing both the cost and inconvenience of multiple separate-use racks.

These and further objects of the present invention are accomplished by the provision of a billiard ball rack capable of alternatively racking different numbers of groups of billiard balls in different shapes comprising a plurality of side members interconnected at their end portions to define a patterned enclosure for receiving a group of billiard balls to shape the group into a first defined pattern; said side members being of a generally upright configuration and having opposed inner and outer surfaces wherein said inner surfaces thereof are adapted to contact said balls at least one of said side members having a leg movable between a storage position wherein said movable leg in turn having opposite ends is disposed against said at least one side member and a use position wherein said leg extends across a portion of said enclosure and in contact with the inner surface of another and opposed side member, said another side member including means for engaging one opposite end of said leg so as to redefine the patterned shape into an alternate use shape.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 3 is a top plan view showing the alternate form of the rack wherein it assumes the shape of a diamond rack;

FIG. 4 is a partial perspective top view with parts cut away for clarity of one side of the rack with its leg moving towards its closed storage position;

FIG. 4*a* is a sectional view along line 4*a* of FIG. 4;

FIG. 4*b* is a view similar to FIG. 4*a* but showing a modified form;

FIG. 5 is a side sectional view along the line 5—5 of FIG. 1;

FIG. 5*a* is a sectional view along line 5*a* of FIG. 5;

FIG. 5*b* is a sectional view similar to FIG. 5*a* but taken in the opposite direction and showing a still further possible modified form;

FIG. 5*c* is a partial perspective view of a leg portion showing a modified form thereof;

DESCRIPTION OF THE INVENTION

Figure 1:
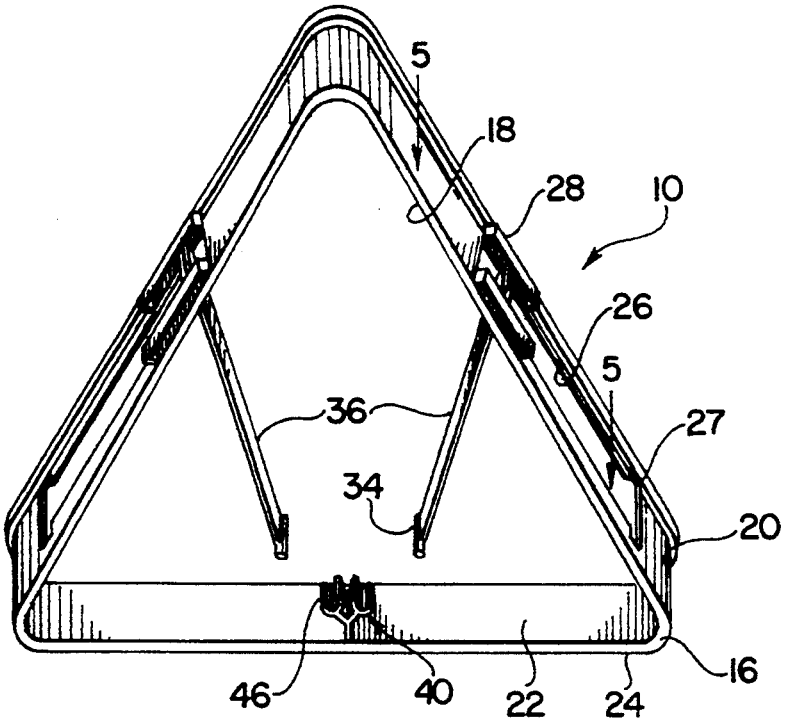
FIG. 1 is a bottom perspective view showing an intermediate position of the device of the present invention between its use as a standard triangular rack and its alternate use as diamond shaped rack.
Figure 2:
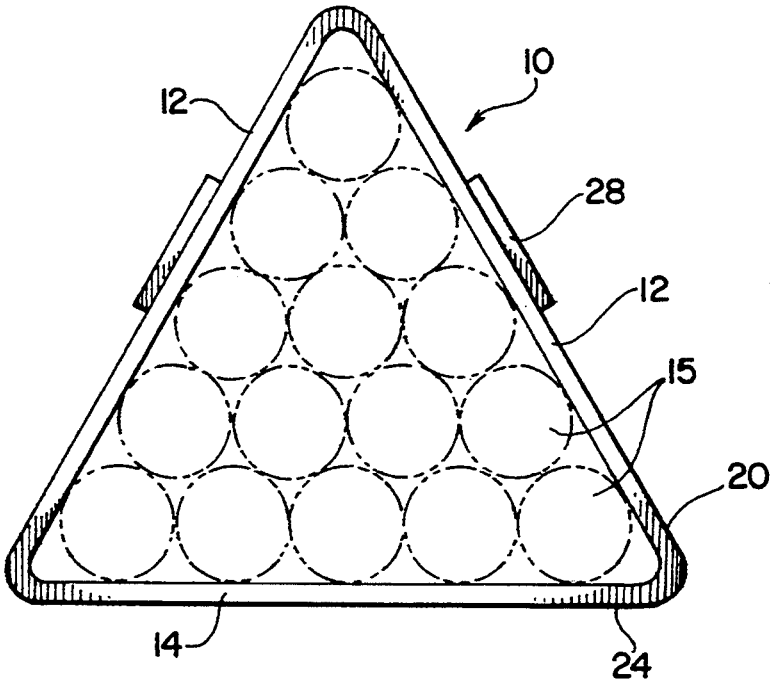
FIG. 2 is a top plan view of the device of the present invention shown as a conventional triangular rack.

Turning now to the drawings and particularly FIG. 1 thereof, the rack 10 of the present invention is shown in an intermediate position whereby it can be converted from a standard triangular rack as shown in FIG. 2 to a nine ball diamond shaped rack as shown in FIG. 3. The rack 10 has a pair of essentially flat upright oriented side members 12 which are opposed to each other and an intermediate base member 14 similarly shaped to the side members 12. In essence, all the members 12 and 14 are essentially identically shaped and formed of a suitable rigid material such as plastic although metal or wood could be also utilized. The members 12 and 14 are interconnected at their end portions to define the standard triangular enclosure for receiving the billiard balls (fifteen of such balls in the case of the standard triangular enclosure as shown in FIG. 2 and nine balls as in the case of the diamond shaped alternate form enclosure as shown in FIG. 3).

It should be apparent that both the side members 12 and the base member 14 include inner and outer surfaces wherein the reference number 18 refers to the inner surfaces of the side members against which the billiard balls 15 are adapted to contact in either of the alternate use modes of the rack 10 and an inner surface 22 of the base member 14. In addition, opposed to the inner side surfaces 18 of the side members 12 are outer surfaces 20. In addition, the base member 14 is provided with an outer surface 24 opposed to the inner surface 22 thereof.

Each of the side members 12 is provided with an open longitudinally extending slot 26. The slot 26 extends from a point proximal to one of the corners 16 upwardly to a point slightly past the middle of the longitudinal extent of each of the side members 12. The slots terminate at their ends proximal the member corners in a generally T-shaped terminus formed by side slot extensions 27.

A pair of longitudinally directed ears 28 outwardly extend from the outer surface 20 of each side member 12 for a short distance at the upper end of the slot 26 and on opposite sides thereof. Each of the ears 28 includes an inner slotted groove 30. The grooves 30 are opposed to each other on either side of the slot 26 such that the terminal fingers 32 of a pin 34 may extend thereinto and be slidably captured thereby. Such pins 34 are provided at the opposite ends of a pair of flat leg members 36 and are in turn adapted for disposition generally within the confines of the slots 26 when the legs 36 are in their storage position as when the rack 10 is used as a standard triangular rack as shown in FIG. 2. This storage position is best illustrated in FIG. 4, 4*a*, 5 and 5*a*.

Referring particularly now to FIGS. 4, 4*a*, 5 and 5*a*, the inside surfaces of the pins 34 are adapted to rest against or frictionally engage the inner surfaces 27*a* of the slot extensions 27. These inner surfaces are also preferably provided with a recess 27*b* as depicted such that the pins 34 in effect are received therein in their storage position. To accomplish such, it may be necessary to carefully dimension the relative lengths of the legs 36 and the slots 26 such that the leg length is slightly different than that of the slot such that a slight stretching or bowing of leg 36 is required to snugly fit it into the slot 26. Also, the recesses 27*b* into which the pins are preferably received or pocketed could be removed from the inner surfaces and placed in the outer surface 27*c*. Such single recess 27*d* positioned on the outer surface 27*c* of the slot extension is shown in FIG. 5*b*—it being apparent that the outer pin surfaces would engage recess 27*d* rather than the inner pin surfaces as in the case of recesses 27*b*. Also as a further alternative structure, the pins 34 could be partially cut away at their inside surfaces to provide a flattened surface 32*a* adapted to particularly engage a similarly non-recessed or flat surface inner surfaces 27*e* as shown in FIG. 4*b*. The essential features of the above-explained variants being that the legs 36 are by these various alternatives adapted to move into the confines of the slots 26 in the storage position and be maintained there essentially out of the way of users' fingers, etc. while the rack 10 is used as a standard triangular rack as shown in FIG. 2.

The leg members 36 are adapted to move from such storage position through the extent of the slot 26 to slide downwardly within grooves 30 while simultaneously swinging inwardly to a point intermediate the length of the base member 14 wherein connector means 40 are provided for the temporary engagement of the pins 34 provided on the opposite ends of the leg members 36.

Generally, the fingers 32 and the pins 34 are integrally formed to the flat leg members 36 although in certain cases the fingers and pins could be integrally formed and then attached to separate leg members or even the pins could be of different materials than the fingers. The opposite action is carried out when the legs are moved from their alternate use position as shown in FIG. 3 to their storage position generally within the lateral extent of the slot 26. Also, it should be brought out that while the disclosed format shows discrete pins 34 terminating in laterally extending fingers 32, the fingers 32 could simply upwardly extend from opposite lateral edges of the legs 36 and need not be of rounded configuration as shown so long as the fingers at the upper ends of the legs provide the necessary slidable contact with the grooves 30 and that the fingers at the lower ends of the leg members are of such an extent to contact portions of the slot 26 in their storage position as previously explained in reference to FIGS. 4*a*, 4*b*, 4*c*, 5*a* and 5*c*.

Figure 6:
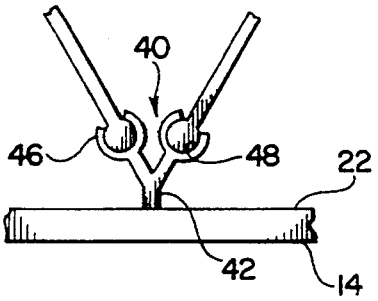
FIG. 6 is an enlarged partial sectional view showing how the stem extending from the base member holds the ends of the legs in place when the rack is converted to a diamond shaped rack.
Figure 6A:
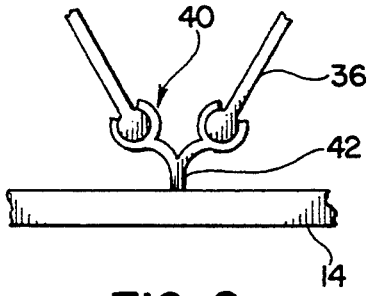
FIG. 6*a* shows how the balls may flatten the engaging stem when the rack is used as a standard diamond shaped rack.

One form of connector 40 is shown in FIGS. 1, 6 and 6*a* wherein a stem 42 upwardly extends from the inner surface 22 of the base member 14 preferably laterally across the width thereof and is provided with a pair of angled fingers 46 forming a pair of grooves 48 for receipt of the pins 34 provided on the opposite or lower ends of the leg members 36. In this manner then, the leg members 36 can be temporarily fastened to a position intermediate of the longitudinal extent of the base member 14 such that the upper portions of the side members 12 and the legs 36 form an equilateral diamond in which nine billiard balls may be racked as shown in FIG. 3. Such alternate use position enables the rack 10 of the present invention to be used not only for standard fifteen ball games but additionally for a number of nine ball games without the necessity of having separate racks for each.

When it is desired to reconvert the rack setup from the alternate nine ball configuration as shown in FIG. 3 back to the standard triangular configuration, it is merely necessary to frictionally disengage the lower leg member pins 34 from the grooves 48 and then swing the leg members 36 towards the side members 12 about the pivot formed at the upper end of the leg members between the pins 34 and the grooves 30 whereupon the leg members may be thereupon moved through the slot 26 into the storage position as best shown in FIGS. 1*a* and 5. The connecting member 40 shown in FIGS. 1 and 6*a* is constructed so as to be flexible enough such that the billiard ball 15 in contact therewith when the rack 10 is used in the standard triangular format merely flattens or at least to some extent deforms the connector 40 so that it does not interfere with the placement of such central lowermost ball in the fifteen ball rack. In many cases however, standard racks provide finger space between the racked balls and the base member and thus the rack of the present invention can also be provided with such a gap in which case no forceful ball contact with the connector 40 or stem 42 occurs.

Figure 9:
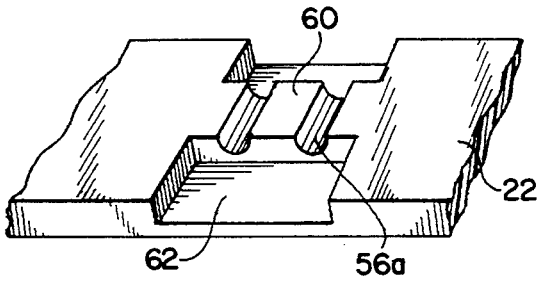
FIG. 9 is a partial perspective view of a still further alternate form of connector configuration similar to FIG. 8.
Figure 7:
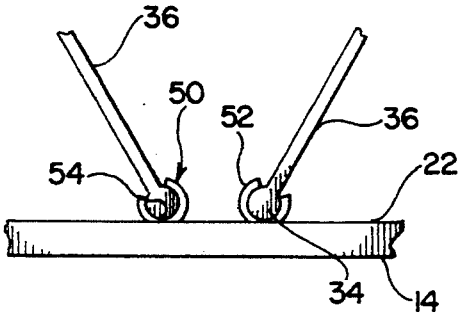
FIG. 7 is a view similar to FIG. 6 but showing an alternate stem connector configuration.
Figure 8:
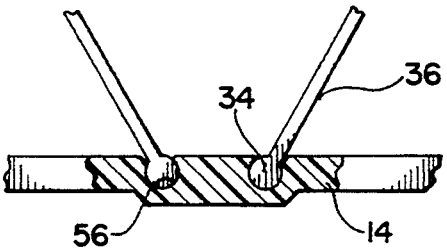
FIG. 8 is a view similar to FIG. 7 but showing a still alternate form in which the leg members are directly attached to the base member.

In some case, such flattening action as above explained in regard to the connector 40 could cause some potential undesirable force against the ball in contact therewith which is then transmitted to the rack as a whole and should such be desired to be eliminated, then either of the alternate configurations as shown in FIGS. 7, 8 and 9 can be utilized. Referring now to the connector means shown in FIG. 7, a pair of connectors 50 in the form of fingers 52 upwardly extending from the inner surface 20 and centrally open to form a groove 54 to accommodate the pins 34 are provided. The placement of the separate connectors 50 is such that they are disposed slightly laterally offset from the midpoint along the longitudinal extent of the base member 14 such that the center billiard ball 15 in the lower row thereof is disposed longitudinally between such separate connector member 50 such that very little, if any, pressure is transmitted to either such central billiard ball or those on opposite sides thereof. Of course in racks provided with a finger gap between the base member and the lowest row of balls, no such pressure or contact would be present.

Turning now to another alternate connector means shown in FIG. 8 therein, the connector is in the form of grooves disposed in the body of the base member 14 such that no upwardly extending fingers such as the fingers 52 as shown in FIG. 7 or the fingers 46 as shown in FIG. 6 are present. Such grooves 56 may be slightly longitudinally offset from each other or may be contiguous but in either case they form the means for receipt of the pins 34 of the leg members 36. In such embodiment, the thickness of the base member 14 is increased to provide the necessary thickness to form such grooves 56.

A further modification and one similar to FIG. 8 is shown in FIG. 9 wherein grooves **56*a* are, in effect, provided in a narrowed height pad 60 formed from a portion of the inside surface 22 of member 14 by reason of the, in effect, removal of adjacent material to form a recessed ramp 62 on either side of the pad. The fingers 32 which are adapted for engagement in the grooves 56*a* enable portions above and below the pad (the pins 34 generally) to overlie the ramps 62. In this way, removal of the legs can easily be effected by slipping one's finger or thumbnail beneath the extending portions of the pins 34** and simply popping them out of the connector.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A billiard ball rack capable of alternatively racking different numbers of groups of billiard balls in different shapes comprising a plurality of side members interconnected at their end portions to define a patterned enclosure for receiving a group of billiard balls to shape the group into a first defined pattern: said side members being of a generally upright configuration and having opposed inner and outer surfaces wherein said inner surfaces thereof are adapted to contact said balls, at least one of said side members having a leg movable between a storage position wherein said movable leg in turn having opposite ends is disposed against said at least one side member and a use position wherein said leg extends across a portion of said enclosure and in contact with the inner surface of another and opposed side member, said another side member including means for engaging one opposite end of said leg so as to redefine the patterned shape into an alternate use shape.

2. The rack as defined in claim 1, said first defined pattern being the standard equilateral triangle and adapted to receive fifteen balls and said alternate use shape being a regular diamond adapted to receive nine balls, there being a pair of said side members with a base member disposed therebetween to form said triangular first pattern, each of said side members having a movable leg movable from said storage position adjacent its respective leg member to its use position intermediate said base member so as to form an equilateral diamond shape as said alternate use shape.

3. The rack as defined in claim 1, said leg member being of a generally flat, elongated configuration and having attachment means at opposite ends thereof, said at least one side member having a pair of longitudinally directed ears each in turn having a groove for the slidable pivotal receipt of one end of said leg member and the other end of said leg member adapted for temporary attachment to said other side member engaging means.

4. The rack as defined in claim 3, said at least one side member having an open longitudinally directed slot having opposite ends and extending from said ears at one end thereof to its opposite end proximal the one end of said at least one side member, said slot adapted to receive said leg member in its storage position.

5. The rack as defined in claim 4, said leg members terminating in laterally extending fingers, the fingers adapted for receipt in said grooves at one end of the leg and alternatively in said engaging means in its alternate use position and against a surface of said at least one side member adjacent said slot in its storage position.

6. A billiard ball rack for alternatively racking billiard balls in a first defined pattern of a standard equilateral triangle of fifteen balls and a second alternative use defined pattern of an equilateral diamond of nine balls comprising a pair of side members with a base member disposed therebetween, said base and side members of equal longitudinal extent and interconnected at their opposite ends to form said standard triangular first pattern, each of said base and side members having inner and outer surfaces and said side members each further having a longitudinally oriented open slot extending from an upper end proximal the middle of said side members to a lower end proximal their end connections with said base member, a pair of longitudinally oriented legs having opposed upper and lower ends and pivotally connected to said side members proximal said slot upper end at the leg upper ends and adapted for positioning generally within the confines of said slot in a storage position where said rack forms said first defined pattern, said legs further adapted to downwardly inwardly pivot about their connection to said side members to said second alternative use position wherein said lower leg ends are removably positioned at points on the inner surface of said base member proximal the middle thereof.

7. The rack as defined in claim 6, said base member inner surface having means for engaging said leg lower ends.

8. The rack as defined in claim 7, said leg member ends having laterally extending pins, said side members having a pair of longitudinally directed ears each in turn having a groove for the slidable pivotal receipt of said leg upper ends and said base member engaging means being a pair of grooves for receipt of said leg lower end pins.

9. The rack as defined in claim 8, said leg member lower end pins adapted to contact co-linear wall portions of said side members adjacent said slot in said storage position.

10. The rack as defined in claim 8, said slot terminating in vertically oriented slot extensions to form a generally T-shaped terminus generally corresponding in shape with the terminus of said leg, said slot extensions defining slot surfaces adapted for contact with the surfaces of said pins in said storage position.

11. The rack as defined in claim 10, said slot surfaces being recessed to receive a rounded pin.

12. The rack as defined in claim 11, said slot surfaces adapted for contact with the surfaces of said pins being inner slot surfaces.

13. The rack as defined in claim 11, said slot surfaces adapted for contact with the surfaces of said pins being outer slot surfaces.

14. The rack as defined in claim 10, said slot surfaces being flat to receive a flat inner surface.

15. The rack as defined in claim 14, said slot surfaces adapted for contact with the surfaces of said pins being inner slot surfaces.

16. The rack as defined in claim 14, said slot surfaces adapted for contact with the surfaces of said pins being outer slot surfaces.

17. The rack as defined in claim 8, said base member engaging means being a pair of generally C-shaped fingers forming an intermediate groove and adapted to frictionally engage said leg lower end pins.

18. The rack as defined in claim 10, said C-shaped fingers disposed side by side and inwardly extending from said base member inner wall.

19. The rack as defined in claim 8, said base member engaging means being a pair of side by side disposed open ended inwardly facing grooves formed essentially entirely within the walls of said base member.

20. The rack as defined by claim 19, said base member grooves of a narrowed height and bordered by recessed ramps such that removal spaces are provided between the ramps and the pins.

* * * * *